US006877415B2

(12) United States Patent
Griesbach et al.

(10) Patent No.: US 6,877,415 B2
(45) Date of Patent: Apr. 12, 2005

(54) INDIVIDUAL PREMEASURED CHARGES WITH REDUCED MOISTURE CONTENT AND METHOD OF PRODUCING SAME

(75) Inventors: Mark Andrew Griesbach, Hortonville, WI (US); Brett Neal Epstein, Boca Raton, FL (US)

(73) Assignee: Legend Products Corporation, Boca Raton, FL (US)

( * ) Notice: Subject to any disclaimer, the term of this patent is extended or adjusted under 35 U.S.C. 154(b) by 0 days.

(21) Appl. No.: 10/695,879

(22) Filed: Oct. 29, 2003

(65) Prior Publication Data

US 2004/0083638 A1 May 6, 2004

Related U.S. Application Data

(60) Provisional application No. 60/423,647, filed on Nov. 1, 2002.

(51) Int. Cl.[7] ..... F42B 39/30

(52) U.S. Cl. ..... 89/34; 89/33.1; 89/27.13; 42/49.01; 42/51; 42/90; 102/288; 102/431; 102/700

(58) Field of Search ..... 42/49.01, 51, 90; 89/33.1, 34, 27.13, 1.1, 1.4, 33.2; 102/288, 431, 700; 86/23; 206/3, 569, 584, 591

(56) References Cited

U.S. PATENT DOCUMENTS 2,220,407 A * 11/1940 Joss ..... 246/488
3,939,967 A * 2/1976 Tenney et al. ..... 206/3
4,222,484 A * 9/1980 Howe ..... 206/3
4,280,407 A * 7/1981 Allen et al. ..... 102/320
4,384,424 A * 5/1983 Fowler ..... 42/90
4,391,780 A * 7/1983 Boris ..... 422/102
4,411,088 A * 10/1983 Wilson ..... 42/90
4,434,890 A * 3/1984 Sieck et al. ..... 206/443
4,440,296 A * 4/1984 Howe et al. ..... 206/3
4,493,239 A * 1/1985 Pedersen ..... 89/1.13
4,715,139 A 12/1987 Rodney, Jr.
4,864,932 A * 9/1989 Reinelt et al. ..... 102/282
4,876,068 A * 10/1989 Castaneda ..... 422/58
4,932,533 A * 6/1990 Collier ..... 206/569
5,012,923 A * 5/1991 Hayes ..... 206/443
5,154,600 A * 10/1992 Sylvestre ..... 431/253
5,158,173 A * 10/1992 Halsey et al. ..... 206/3
5,212,337 A * 5/1993 Patteri et al. ..... 89/34
5,435,089 A 7/1995 Rodney, Jr.
5,458,044 A * 10/1995 Delbos ..... 89/33.1
5,712,444 A * 1/1998 Brion et al. ..... 102/202
5,726,378 A * 3/1998 Barrett ..... 102/288
5,911,323 A * 6/1999 Bapst ..... 206/446
6,135,431 A * 10/2000 Muhmel et al. ..... 261/101
6,305,544 B1 * 10/2001 Shacklee ..... 206/509
6,314,670 B1 11/2001 Rodney, Jr.
6,626,286 B2 * 9/2003 Boutet et al. ..... 206/3
6,629,597 B2 * 10/2003 Barker ..... 206/3
6,688,232 B2 * 2/2004 Griesbach et al. ..... 102/288

FOREIGN PATENT DOCUMENTS

DE 19753956 * 6/1999

* cited by examiner

*Primary Examiner*—Michael J. Carone
*Assistant Examiner*—John Richardson
(74) *Attorney, Agent, or Firm*—Davis & Bujold, P.L.L.C.

(57) ABSTRACT

A transport container with a removable cover which is repeatedly removable and refastenable to the transport container. The transport container is sized to accommodate a plurality of individual premeasured charges of gunpowder. Each of the plurality of individual premeasured charges of gunpowder comprises a tube which is open at least one end thereof and the at least one open end of the tube is sealed with a removable cap once a suitable quantity of the loose granular charge of gunpowder is loaded therein. Each individual premeasured charge of gunpowder is loaded with gunpowder which has a relatively low moisture content to facilitate reliable and substantially complete ignition of all of the gunpowder ignition, upon detonation of a firearm.

22 Claims, 4 Drawing Sheets

INDIVIDUAL PREMEASURED CHARGES WITH REDUCED MOISTURE CONTENT AND METHOD OF PRODUCING SAME

This application claims the benefit of provisional application No. 60/423,647, filed Nov. 1, 2002.

FIELD OF THE INVENTION

The present invention relates to a packaging system for gunpowder comprising a transport container, a plastic bottle, a plastic container or some other package having a plurality of individual packages or containers carrying loose granular gunpowder that can be rapidly loaded within a firearm.

BACKGROUND OF THE INVENTION

In the prior art, there are a variety of mechanisms, tools and devices to facilitate loading of loose granular gunpowder within the barrel of a firearm. For example, there are a variety of speed loader tools, typically costing between $3 and $10 or so a piece, which are designed to accommodate a desired premeasured load of loose granular gunpowder. These speed loaders are typically cylindrical components which are open at one, or possibly at both opposed ends thereof, and sized to accommodate only gunpowder or possibly both gunpowder and a desired projectile. The user typically purchases one or more speed loader tools and also purchases a separate supply of gunpowder and a separate supply of projectiles. Then the user will measure a desired quantity of gunpowder, and possibly also place load a desired projectile, into the speed loader tool and then affix a cap to the open end of the speed loader tool to seal the gunpowder, and possibly the projectile, within the speed loader tool for later use.

One problem associated with such known speed loader tools is that they are relatively expensive to acquire, generally numerous speed loader tools must be purchased to support a single hunter during a hunting excursion. In addition, the speed loader tools are labor intensive since the purchaser of the speed loader tool must individually measure and load a desired measure of granular charge of gunpowder, and possibly a desired projectile, into the speed loader tool and then seal the speed loader tool with a suitable cap(s). During the loading process, moisture can be readily absorbed by the gunpowder and such moisture tends to make the gunpowder somewhat more difficult to ignite, upon discharge of the firearm, and such moisture can possibly result in malfunction, a delayed firing or a misfiring of the firearm.

It is also well known, in the black powder art, to compress loose granular gunpowder into a unitary premeasured compressed charge of gunpowder. Such unitary premeasured compressed charges, however, frequently absorb a significant amount of moisture and thus can be difficult to ignite and/or burn completely due to the increased moisture level and/or compactness of the granules forming the compressed charges, i.e., the density of the compressed charge, and such charges also have a tendency to absorb moisture when exposed to air or the environment for prolonged periods of time. As such, the known compressed charges also can be sometimes difficult to ignite and burn upon discharge of a firearm. In any event, compressed charges generally do not propagate an ignition flame as well as loose granular powder will upon discharge of a firearm.

SUMMARY OF THE INVENTION

Wherefore, it is an object of the present invention to overcome the above mentioned shortcomings and drawbacks associated with the prior art.

Another object of the present invention is to provide a transport container which carries a plurality of individual premeasured loads of gunpowder therein whereby each individual premeasured load of gunpowder is premeasured and loaded at the factory so that each individual premeasured load of gunpowder (1) contains a precise volumetric amount of gunpowder (e.g., about ±10% more preferably ±5%) and (2) is essentially free of excess moisture, e.g., the gunpowder typically contains between 0.1 and 5.0% moisture by weight. In addition, each one of the individual premeasured loads of gunpowder is loaded and sealed within a sealed transport container which further minimizes the possibility that any of the individual premeasured loads of gunpowder will absorb a significant amount of moisture.

A further object of the present invention is to remove as much moisture as possible from the gunpowder prior to measuring a desired amount of gunpowder into one of the individual sleeves or tubes to form a premeasured load of gunpowder.

Yet another object of the present invention is to facilitate easy carrying of the gunpowder, while hunting or target practicing, without exposing the gunpowder to moisture or the elements of the environment.

Still a further object of the present invention is to facilitate quick and rapid loading of a firearm with gunpowder for a subsequent shot.

A further object of the present invention is to minimize human contact with the gunpowder during the handling and the loading process by the end user.

Yet another object of the present invention is to package the gunpowder in separate, individual premeasured charges to facilitate safer handling of the gun powder and reduce inadvertent ignition of the gun powder.

Another object of the present invention is provide an individual premeasured charge having an exterior packaging which is water resistant, water proof, moisture proof, and/or air tight.

A still further object of the present invention is to provide a package in which both the gunpowder and a desired projectile can be prepackaged in the same individual premeasured load at the factory or other manufacturing facility.

The present invention relates to a packaging system comprising: a transport container having a removable cover which is repeatedly removable and refastenable to the transport container, the transport container being sized to accommodate a plurality of individual premeasured charges of gunpowder; each of the plurality of individual premeasured charges of gunpowder comprising a tube which is open at at least one end thereof, the open end of the tube being sealed with a removable cap once a suitable quantity of the loose granular charge of gunpowder is loaded therein, and the gunpowder for each of the plurality of individual premeasured charges having a moisture content of less than 5.0% by weight to facilitate reliable ignition of the gunpowder, upon detonation of the firearm, and substantially complete ignition of all of the gunpowder.

The present invention relates to a method of packaging gunpowder with a reduced moisture content, the method comprising the steps of: providing a transport container having a removable cover which is repeatedly removable and refastenable to the transport container, and sizing the transport container to accommodate a plurality of individual premeasured charges of gunpowder; providing a plurality of individual premeasured charges of gunpowder with each of the plurality of individual premeasured charges of gunpowder comprising a tube which is open at least one end thereof;

drying the gunpowder to have a moisture content of less than 5.0% by weight to facilitate reliable ignition of the gunpowder, upon detonation of the firearm, and substantially complete ignition of all of the gunpowder prior to loading; loading the gunpowder with a moisture content of less than 5.0% by weight within the tube; and sealing the open end of the tube with a removable cap following loading of a suitable quantity of the loose granular charge of gunpowder therein to form one of the plurality of individual premeasured charges.

BRIEF DESCRIPTION OF THE DRAWINGS

The invention will now be described, by way of example, with reference to the accompanying drawings in which.

DETAILED DESCRIPTION OF THE INVENTION

Figure 1:
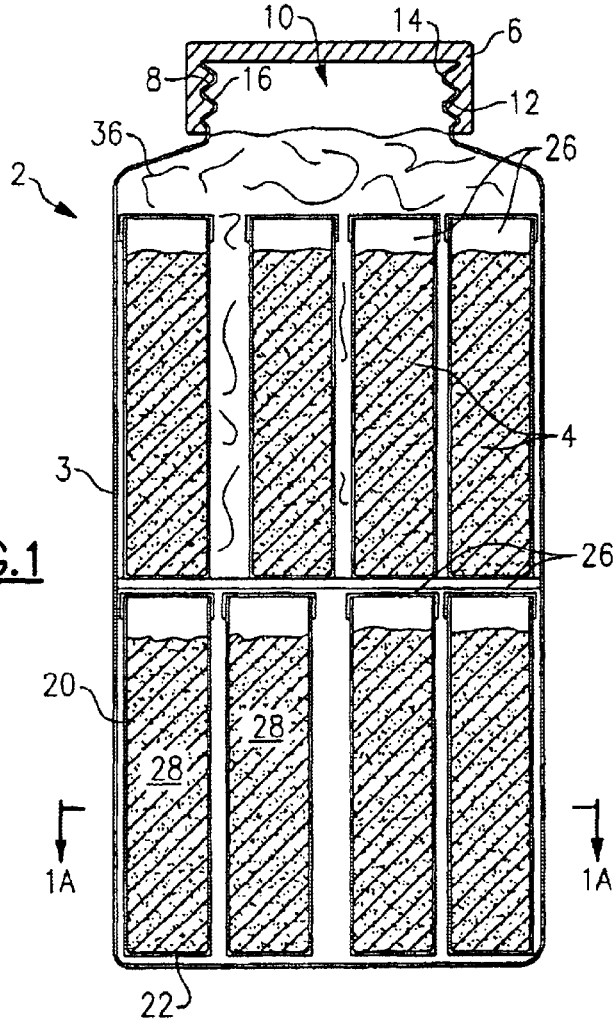
FIG. 1 is a diagrammatic sectional view showing a transport container containing a plurality of individual premeasured loads of gunpowder.
Figure 1A:
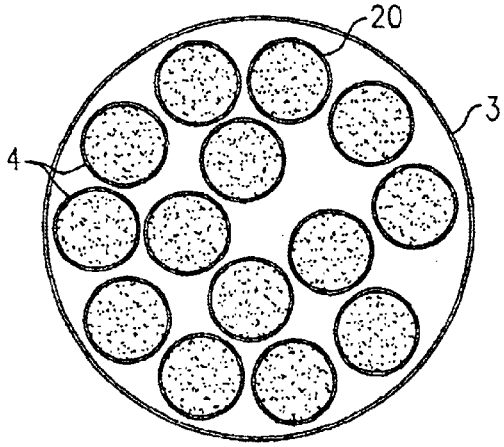
FIG. 1A is a diagrammatic cross sectional view of the transport container containing the plurality of individual premeasured loads of gunpowder along section line 1A—1A of FIG. 1.
Figure 1B:
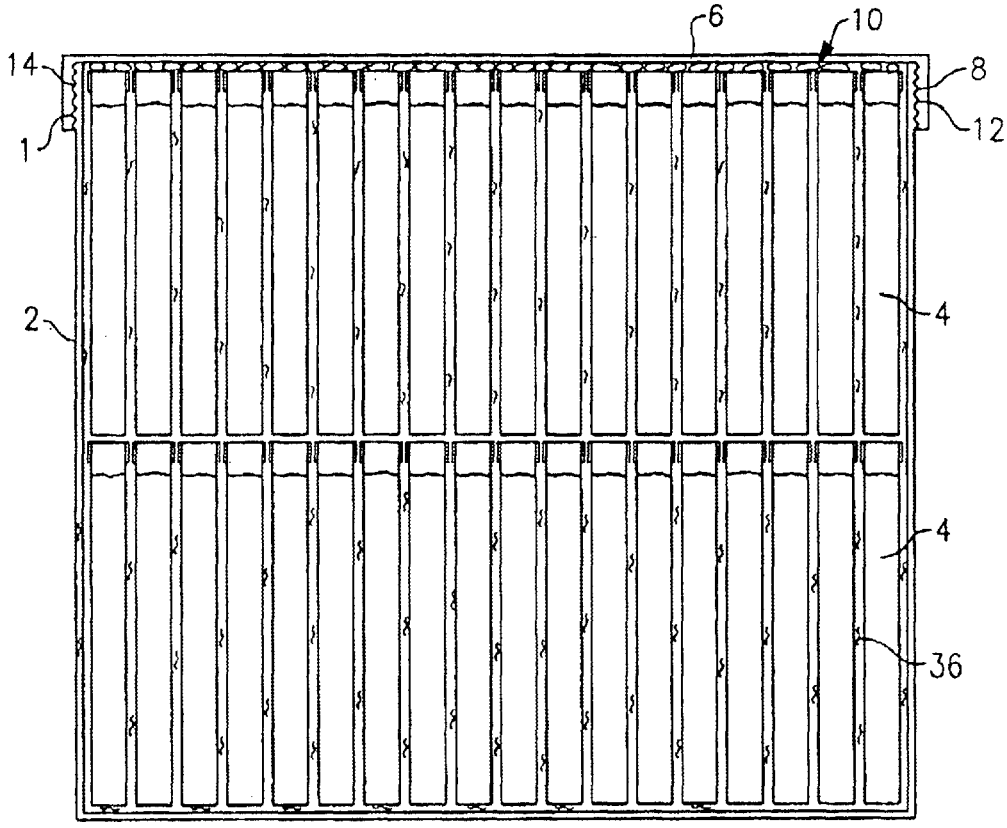
FIG. 1B is a diagrammatic view showing another embodiment of the transport container.

Turning now to FIG. 1, a brief description concerning the various components of the present invention will first be briefly discussed. As can be seen in this Figure, a transport container, such as a plastic bottle, a plastic container or some other package 3 (hereinafter all referred to as a transport container 2) is loaded, at the factory or some other manufacturing facility, with a plurality of individual premeasured charges 4 of gunpowder, typically between 5 and 1000, more particularly between 10 and 200, and most preferably between 15 and 50. In the embodiment shown in FIGS. 1 and 1A, twenty five (25) individual premeasured charges 4 are accommodated within the transport container 2 (e.g., approximately thirteen (13) to individual premeasured charges on the first level and approximately twelve (12) individual premeasured charges on the second level) while in the transport container 2 shown in FIG. 1B, significantly more individual premeasured charges 4 are accommodated therein. The transport container 2 has a removable cover 6 which is repeatedly removable and refastenable to the transport container 2 by an end user. An exterior surface 8 of the opening 10 of the transport container 2 is provided with a male thread 12 while an inwardly facing surface 14 of the cover 6 is provided with a mating female thread 16 to facilitate such repeated removing and refastening of the cover 6 to the transport container 2. The transport container 2 insulates the individual premeasured charges 4 from the surrounding environment and minimizes exposure of the individual premeasured charges 4 to moisture.

Figure 1C:
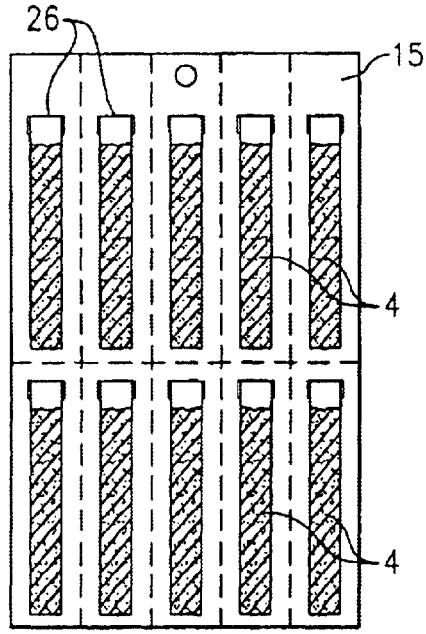
FIG. 1C is a diagrammatic view showing a blister pack embodiment of the transport container.
Figure 2A:
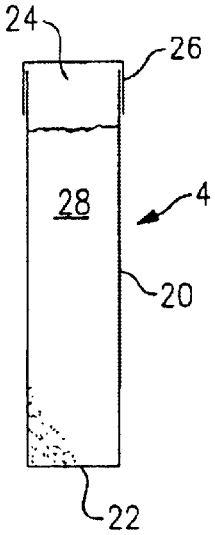
FIG. 2A is a diagrammatic cross sectional view showing one of the plurality of individual premeasured loads of gunpowder contained within the transport container of FIG. 1 with a first embodiment of a cap.
Figure 2B:
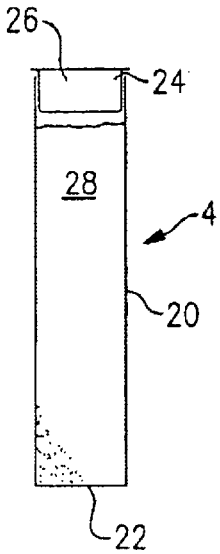
FIG. 2B is a diagrammatic cross sectional view showing one of the plurality of individual premeasured loads of gunpowder having a second embodiment of a cap.

Alternatively, as can be seen in FIG. 1C, the individual premeasured charges 4 may possibly be enclosed within conventional blister packaging material 15 so that each individual premeasured charge is separately packaged and separately removable. The blister packaging material 15 further minimizes the exposure of each individual premeasured charges 4 to moisture. When use of one of the individual premeasured charges 4 is desired, the end user will merely cut, remove or tear away a the necessary portion of the blister packaging material 15, containing the desired individual premeasured charge(s), so that the end user can readily access and remove the desired individual premeasured charge(s) 4 for use with a desired fire arm while the remaining individual premeasured charge(s) 4 still remain within the blister packaging material 15. If desired, a plurality of perforations (not numbered), e.g., horizontal and/or vertical perforations, may be formed in the blister packaging material 15 to facilitate cutting or tearing of desired portion of the blister packaging material 15 to remove one or more desired individual premeasured charge(s) 4. It is also possible to package a number of individual premeasured charge (s) together with one another in a section or sections of the blister packaging material 15. Each one of the individual premeasured charges 4 of gunpowder comprises an outer container or packaging, typically a cylindrical plastic sleeve or tube 20 preferably manufactured from a moisture impermeable plastic material, which is closed at a first base end 22 and open at a second opposed end 24 thereof. The plastic sleeve or tube 20 is typically undersized (see FIGS. 2A, 2B, 2C, 2D, but not FIG. 3) for the desired gun barrel—that is it can not carry a projectile 29 sized for the desired barrel—so that the open end 24 of the plastic tube 20 is partially received within the barrel of the firearm during loading. The outside diameter of the sleeve or tube 20 is approximately between 0.02 inches to 0.1 inches larger than the inside diameter of the sleeve or tube 20. The open end 24 of the plastic sleeve or tube 20 is sealed at the factory or other manufacturing facility with a removable cap 26 (e.g., a cap, a plug, a cover, a pull tab, a flip-top closure or other some other closure all of which are hereinafter referred to as a "cap") once a suitable quantity of the loose granular charge of gunpowder 28 is loaded therein.

Figure 2C:
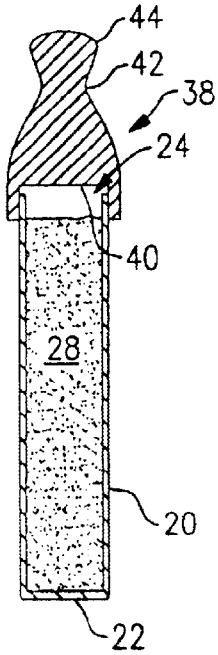
FIG. 2C is a diagrammatic cross sectional view showing one of the plurality of individual premeasured loads of gunpowder having a pull tab type cap.

With reference to FIG. 2C, a pull tab embodiment of the cap is depicted. The pull tab 38, according to this embodiment, somewhat resembles the shape of a bowling pin. The pull tab 38 has a recess 40, at a first end thereof, which is sized to matingly fit over and provide a moisture tight seal with open end 24 of the plastic tube 20. The opposite end of the pull tab 38 extends a sufficient distance away from the open end of the cylindrical plastic sleeve or tube 20 and forms a smaller diameter grip or handle 42 to facilitate gripping or grasping by a hand, a pair of fingers, a mouth, teeth, a pair of lips, etc., of an end user so that the pull tab 38 can be readily grasped and removed from its engagement with the open end of the cylindrical plastic sleeve or tube 20 to provide access to the stored gun powder 28. If desired, the remote free end of the pull tab 38 may be provided with an enlarged head 44 having a variety of different shapes. In all other respects, this embodiment is substantially identical to the previously discussed embodiments.

Figure 2D:
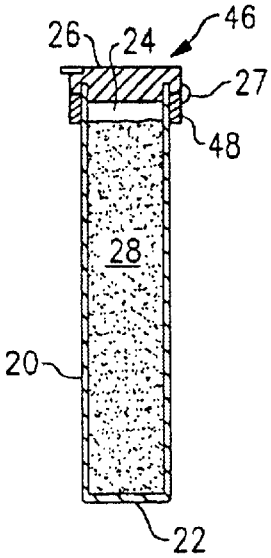
FIG. 2D is a diagrammatic cross sectional view showing one of the plurality of individual premeasured loads of gunpowder having flip-top type cap.

Still another embodiment of the cap is diagrammatically shown in FIG. 2D in which the cap comprises a flip-top type closure 46. According to this embodiment, the cap 26 generally includes a flip-top closure 46 pivotal attached to the open end 24 of the plastic sleeve or tube 20. It is possible that the flip-top closure is pivotal supported by a base 48 which is either permanently attached or affixed about the open end 24 of the plastic sleeve or tube 20 or formed integral therewith. The flip-top closure 46 has a hinge 27 integrally connected with the base 48 and the flip-top closure 46. The flip-top closure 46 has a close position (see FIG. 2D) in which the flip-top closure 46 provides a moisture tight seal with the open end 24 of the plastic sleeve or tube 20 and an open position (not shown) in which the flip-top closure 46 is pivoted away from the open end 24 of the plastic sleeve or tube 20, via hinge 27, to allow access and pouring of the stored gun powder 28 from the plastic sleeve or tube 20. In all other respects, this embodiment is substantially identical to the previously discussed embodiments.

Figure 3:
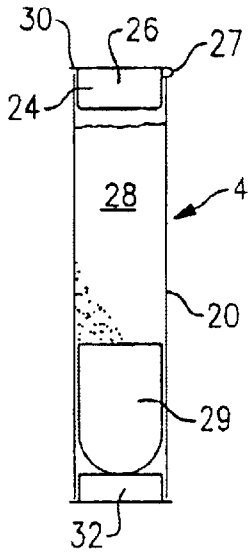
FIG. 3 is a diagrammatic cross sectional view showing another embodiment of an individual premeasured load of gunpowder.

In an alternative embodiment shown in FIG. 3, the plastic sleeve or tube 20 has a diameter which is substantially identical to the bore diameter of the gun barrel, i.e., either substantially the same size or slightly larger in size. According to this embodiment, the end user aligns the sleeve or tube 20 concentrically with the bore opening of the gun barrel so that the gunpowder and the projectile 29 can be poured into and loaded within the barrel of the firearm. To assist with such loading, the cap 26 is first removed and the individual premeasured charge 4 of gunpowder is inverted to pour the gunpowder 28 into the barrel. Such pouring of the gunpowder 28 also has a tendency to commence loading of the projectile 29 within the barrel. In necessary, the second cap 32 can be removed to assist with loading of the projectile 29. Finally, the projectile 29 is rammed with a ram rod to seat the gunpowder and the projectile against the breach end of the gun barrel.

The removable cap 26 is typically manufactured from plastic or vinyl or some other suitable material. The removable cap 26 can be either completely removable from the plastic sleeve or tube 20 (see FIGS. 2A, 2B and 2C) or can have a hinge 27 integrally connected with one end region of the plastic sleeve or tube 20 (see FIGS. 2D and 3). If desired the removable cap can be provided with a protruding lip or latch 30 to facilitate an end user easily removing the cap 26 from its sealing engagement with the open end 24 of the plastic sleeve or tube 20, and loading of the loose granular charge of gunpowder 28, contained within the individual premeasured charge of gunpowder 4, into the firearm (usually the muzzle end).

Typically each one of the individual premeasured charges 4 of gunpowder is sized to carry a charge of gunpowder of between 20 to 200 grains by weight, and more preferably each one of the individual premeasured charges 4 of gunpowder is sized to carry a charge of gunpowder of between 40 and 150 grains by weight. The inside diameter of the cylindrical plastic sleeve or tube 20 can vary, depending upon the particular application. For example, the plastic sleeve or tube 20 can have an inside diameter of between about 0.10 inches to about 2.0 inches, more preferably an inside diameter of between about 0.300 inches to about 0.650 inches and most preferably the plastic sleeve or tube 20 can have a diameter of between about 0.350 inches to about 0.550 inches or so. In addition, the length of the plastic sleeve or tube 20 can vary depending upon the quantity of gunpowder to be carried by the individual premeasured charges 4 of gunpowder 4. Typically each one of the individual premeasured charges 4 of gunpowder has an axial length of between about 0.50 inches to about 7.50 inches, and more preferably each one of the individual premeasured charges 4 of gunpowder has an axial length of between about 1.50 inches to about 5.00 inches or so.

Preferably each individual premeasured charge 4, once the cap 26 is affixed to the cylindrical plastic sleeve or tube 20, forms a packaging which typically is water resistant, water proof, moisture proof, and/or air tight. That is, each individual premeasured charge 4 is able to resist penetration of moisture into the stored gunpowder when the individual premeasured charge 4 is submerged, at a depth of a few feet, in water for a prolonged period of time, e.g., at least six months. This arrangement prevents the stored gunpowder from absorbing any moisture while the individual premeasured charge 4 is being stored prior to use.

The advantage of the present invention is that the individual premeasured charges 4 of gunpowder are loaded at the manufacturing facility shortly after the gunpowder is produced, at step 50. It is to be appreciated that if the gun powder is not cooked during the production process, or even if it is cooked, it is desirable to dry the gunpowder prior to loading the relatively low moisture content gunpowder within the cylindrical plastic sleeve or tube 20. Accordingly a drying step 52 is provided between the manufacturing step 50 and the loading step 54. The gunpowder, following manufacture thereof and the drying step, typically has a relatively low moisture content, e.g., the gunpowder contains between 0.1 and 5.0% moisture by weight. This relatively low moisture content gunpowder is then loaded within a cylindrical plastic sleeve or tube 20, at step 54, and then a cap 26 is secured to close and seal the open end of the cylindrical plastic sleeve or tube 20, at step 56, to form an individual premeasured charge of gunpowder 4.

Once a desired number of individual premeasured charges 4 of gunpowder are produced, they are loaded within a desired transport container 2, at step 58. Packaging material 36 may be added to the transport container 2, at step 60 if necessary, to protect the individual premeasured charge of gunpowder from damage during shipping and/or transportation. The packaging material 36 assists with minimizing the side to side and/or the up and down shifting of the individual premeasured charges 4 during shipment of the transport container 2. Then a removable cap 6 is affixed to the transport container 2, as step 62, to close and seal the plurality of the individual premeasured charges 4 of gunpowder therein and minimize exposure of the individual premeasured charges 4 to the elements of the environment. If desired, the transport container 2 can be vacuum sealed, in a conventional manner, to further reduce the possibility that any substantial amount of moisture will be contained within the transport container 2. Finally, the transport container 2 is then shipped and sold, at step 64.

As a result of the gunpowder being prepackaged at the manufacturing facility essentially free of moisture, this reduced or minimized level of moisture and facilitates a more reliable combustion or ignition of the gunpowder by the end user, upon detonation of the firearm. The reduced moisture in the gun powder also facilitates better propagation of the flame, during ignition of the gunpowder, so that a substantially complete ignition of all of the gunpowder contained within the gun barrel readily occurs. The complete ignition also minimizes the possibility of any hot embers being discharged from the muzzle end of the barrel and further assists with maximizing the projectile velocity out of the muzzle end of the gun barrel. The individual premeasured charges 4 of gunpowder can increase the accuracy and consistency of the loaded charge while also reducing spillage of the gunpowder during the loading process. Finally, as these individual premeasured charges 4 of gunpowder come prepackaged directly from the factory or other manufacturing facility, they are generally quicker and easier to use by the end user while hunting or target practicing.

Figure 5:
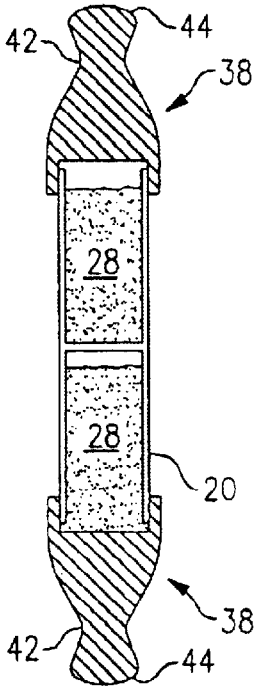
FIG. 5 is a diagrammatic drawing showing two individual premeasured charges affixed to one another, base to base, to form a unitary packaging structure.
Figure 4:
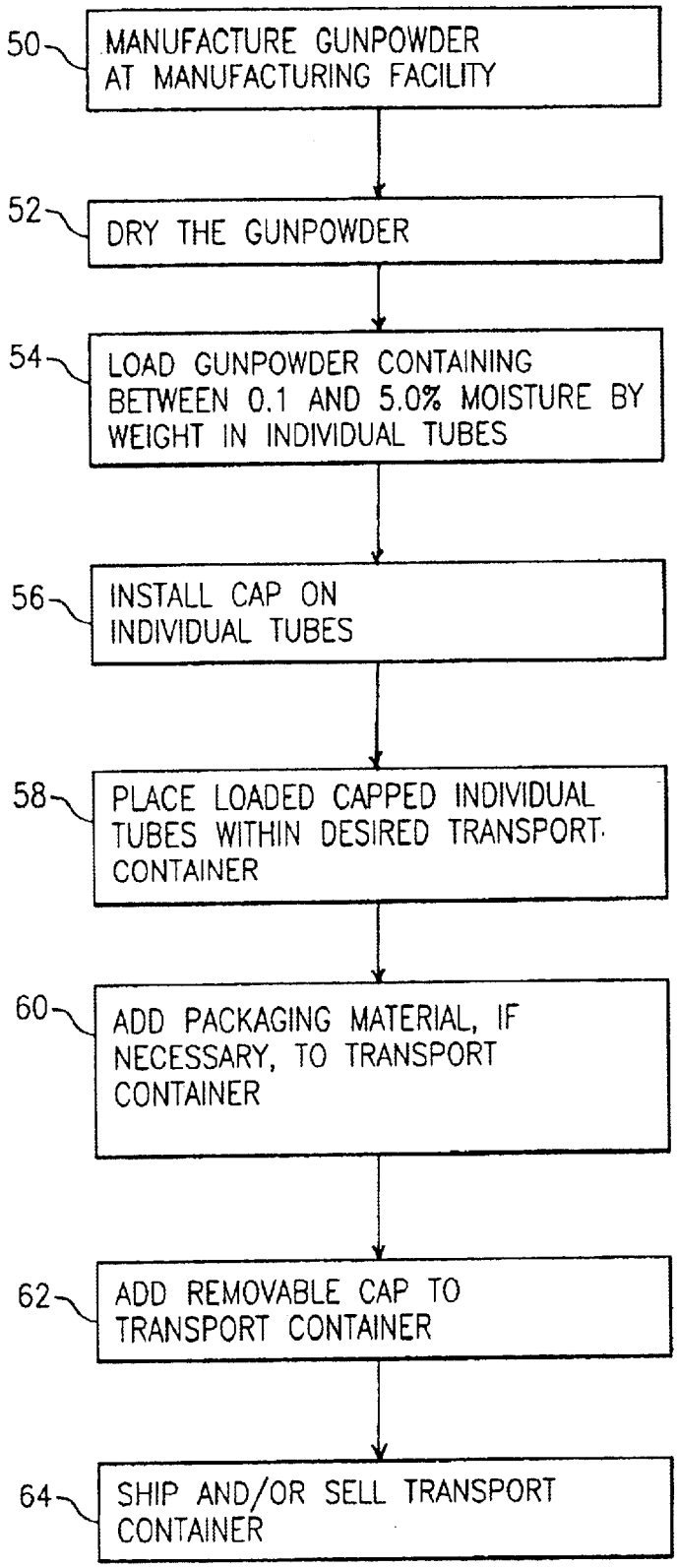
FIG. 4 is a diagrammatic flow diagram showing the process for manufacturing the transport container containing a plurality of individual premeasured loads of gunpowder.

It is to be appreciated that two or more individual premeasured charges 4 can be affixed or otherwise secured to one another, base to base (see FIG. 5), to form a unitary packaging structure. One type of gunpowder, e.g., a priming charge, can be stored in one of individual premeasured charges while the main charge, e.g., black powder, a black powder substitute, etc., can be stored in the other individual premeasured charge. Alternatively the main charge, e.g., black powder, a black powder substitute, etc., can be stored in one of individual premeasured charges while one or more projectiles can be stored in the other individual premeasured charge. The possibility are endless and would be readily apparent to those skilled in this art.

Each transport container will typically accommodate between 15 and 50 individual premeasured charges 4 of gunpowder. Typically each of the individual premeasured charges 4 of gunpowder will contain between 20 and 200 grains of gunpowder by weight.

While the sleeve or tube 20 is described as being manufactured from plastic, it is to be appreciated that other types of materials can be utilized. For example, the sleeve or tube 20 can be manufactured from paper, card board, aluminum foil, wax paper, or any other well known and/or conventional packaging material. An important function of the sleeve or tube 20 is that it is suitably sized to accommodate a desired quantity of gunpowder while also providing at least a moisture resistant barrier or layer, and more preferably a moisture impermeable barrier or layer, between the gunpowder and the external environment to prevent the gunpowder from absorbing any significant amount of moisture while it is being stored. It should be noted that the transverse cross sectional shape of the tube can vary, e.g., the tube can be, for example, circular, oval, oblong, square, triangular, hexagonal, pentagonal, or another polygonal shape, etc. In some applications, a square, a triangular or a hexagonal transverse cross section shape for the tube to facilitate pouring of the gunpowder is preferred. It is also possible that a solid and/or compressed premeasured charge, pellet, molded charge, etc., may be stored in the individual premeasured charge, i.e., within the plastic sleeve or tube 20 having the removable cap 26 affixed thereto.

By packaging the gunpowder in separate, individual premeasured charges 4, this provides safer handling of the gun powder and, in the event that the transport container should some how inadvertently ignite, the resulting damage will be significantly reduced due to the individual packaging.

Since certain changes may be made in the above described improved individual premeasured charges of gunpowder and method for producing the same, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A packaging system comprising:

a transport container having a removable cover which is repeatedly removable and refastenable to the transport container, the transport container accommodating a plurality of tubes with each tube carrying an individual premeasured charge of gunpowder;

each one of the plurality of tubes being open at least one end thereof, the open end of each tube being sealed with a removable cap once a suitable quantity of a loose granular charge of gunpowder is loaded therein to form an individual premeasured charge of gunpowder, and the gunpowder for each of the individual premeasured charges of gunpowder having a moisture content of less than 5.0% by weight to facilitate reliable ignition of the gunpowder, upon detonation of the firearm, and substantially complete ignition of all of the gunpowder; and the removable cap, once assembled with the tube, forms an exterior packaging which is at least one of water resistant, water proof, moisture proof, and air tight.

2. The packaging system according to claim 1, wherein the removable cap is completely removable from the tube.

3. The packaging system according to claim 1, wherein the removable cap has a hinge integrally connected with the open end of the tube.

4. The packaging system according to claim 1, wherein the removable cap has a protruding latch to facilitate an end user gripping and removing the cap from its sealing engagement with the open end of the tube.

5. The packaging system according to claim 1, wherein each one of the plurality of tubes carries between 20 to 200 grains by weight of gunpowder.

6. The packaging system according to claim 1, wherein each one of the plurality of tubes has an inside diameter of between about 0.10 inches to about 2.0 inches.

7. The packaging system according to claim 1, wherein each one of the plurality of tubes has an axial length of between about 0.50 inches to about 7.50 inches.

8. The packaging system according to claim 1, wherein the removable cap includes a pull tab which facilitates an end user gripping or removing the cap from its sealing engagement with the open end of the tube.

9. The packaging system according to claim 1, wherein the cap is a flip-top closure with a base affixed to the open end of the tube, the flip-top closure has a close position in which the flip-top closure provides a moisture tight seal with the open end of the tube and an open position in which the flip-top closure is pivoted away from the open end of the tube to allow access and pouring of the gunpowder loaded therein.

10. The packaging system according to claim 1, wherein each one of the plurality of tubes carries both gunpowder and a projectile therein.

11. The packaging system according to claim 1, wherein the removable cap is a pull tab which has a recess, at a first end thereof, which is sized to mainly fit over and provide a moisture tight seal with the open end of the tube, and an opposite end of the pull tab extends away from the tube and forms a smaller diameter handle to facilitate grasping thereof by an end user so that the pull tab can be readily grasped and removed from its engagement with the open end of the tube to provide access to the gunpowder loaded therein.

12. A transport container having a removable cover which is repeatedly removable and refastenable to the transport container, the transport container accommodating a plurality of tubes with each tube carrying an individual premeasured charge of gunpowder, each one of the plurality of tubes being open at least one end thereof, the open end of each tube being sealed with a removable cap once a suitable quantity of a loose granular charge of gunpowder is loaded therein to form an individual premeasured charge of gunpowder, and the gunpowder, for each individual premeasured charge of gunpowder, having a moisture content of less than 5.0% by weight to facilitate reliable ignition of the gunpowder, upon detonation of the firearm, and substantially complete ignition of all of the gunpowder;

the removable cap is completely removable from the tube to facilitate an end user removing the cap from its sealing engagement with the open end of the tube;

each one of the plurality of tubes carries between 20 to 200 grains by weight of gunpowder; and each one of the plurality of tubes has an inside diameter of between about 0.300 inches to about 0.650 inches and has an axial length of between about 0.50 inches to about 7.50 inches.

13. The packaging system according to claim 12, wherein the removable cap has a protruding latch which facilitates an end user removing the cap from its sealing engagement with the open end of the tube.

14. The packaging system according to claim 12, wherein the removable cap has a pull tab which facilitates an end user gripping or removing the cap from its sealing engagement with the open end of the tube.

15. The packaging system according to claim 12, wherein each one of the plurality of tubes carries both gunpowder and a projectile therein.

16. The packaging system according to claim 12, wherein the cap is a flip-top closure with a base affixed to the open end of the tube, the flip-top closure has a close position in which the flip-top closure provides a moisture tight seal with the open end of the tube and an open position in which the flip-top closure is pivoted away from the open end of the tube to allow access and pouring of the gunpowder loaded therein.

17. The packaging system according to claim 12, wherein the removable cap is a pull tab which has a recess, at a first end thereof, which is sized to mainly fit over and provide a moisture tight seal with the open end of the tube, and an opposite end of the pull tab extends away from the tube and forms a smaller diameter handle to facilitate grasping thereof by an end user so that the pull tab can be readily grasped and removed from its engagement with the open end of the tube to provide access to the gunpowder loaded therein.

18. A method of packaging gunpowder with a reduced moisture content, the method comprising the steps of:

providing a transport container having a removable cover which is repeatedly removable and refastenable to the transport container, and sizing the transport container to accommodate a plurality of tubes each containing an individual premeasured charge of gunpowder;

forming an open end in at least one end each of the plurality of tubes;

drying gunpowder, prior to loading, to have a moisture content of less than 5.0% by weight to facilitate reliable ignition of the gunpowder, upon detonation of a firearm, and substantially complete ignition of all of the gunpowder;

loading the gunpowder, with a moisture content of less than 5.0% by weight, within the one end of each one of the plurality of tubes;

sealing the open end of each tube with a removable cap, following loading of a suitable quantity of loose gunpowder therein, to form an individual premeasured charges; and placing the within the transport container and sealing the transport container with the removable cover.

19. The method according to claim 18, further comprising the step of removing the removable cover from the transport container;

removing at least one desired individual premeasured charge from the transport container; and placing the removable cover back on the transport container.

20. The packaging system according to claim 1, wherein at least one of the plurality of tubes of is open at both opposed ends and a removable cap seals each open end.

21. The packaging system according to claim 1, wherein the transport container has a first thread and the removable cover has a mating second thread, and the mating first and second threads facilitate repeated removing and refastening of the removable cover with the transport container.

22. The packaging system according to claim 12, wherein the transport container has a first thread and the removable cover has a mating second thread, and the mating first and second threads facilitate repeated removing and refastening of the removable cover with the transport container.

* * * * *